United States Patent [19]

Williams

[11] 4,060,299

[45] Nov. 29, 1977

[54] ELECTRICAL CONNECTOR

[76] Inventor: Robert A. Williams, 55 Bounty Road East, Fort Worth, Tex. 76116

[21] Appl. No.: 703,622

[22] Filed: July 8, 1976

[51] Int. Cl.[2] ..... H01R 13/54

[52] U.S. Cl. ..... 339/48; 339/89 R; 339/94 R; 339/268 R

[58] Field of Search ..... 339/48, 49 R, 49 B, 339/89 R, 89 C, 89 M, 94 R, 94 A, 94 C, 94 M, 130 R, 130 C, 268 RS

[56] References Cited

U.S. PATENT DOCUMENTS

| | | | |
|---|---|---|---|
| 2,690,542 | 9/1954 | Pearce | 339/48 |
| 3,104,144 | 9/1963 | Sprole | 339/89 M |
| 3,683,320 | 8/1972 | Woods | 339/130 C |
| 3,816,641 | 6/1974 | Iversen | 339/94 R |

FOREIGN PATENT DOCUMENTS

| | | | |
|---|---|---|---|
| 12,150 | 8/1915 | United Kingdom | 339/268 |

*Primary Examiner*—Roy Lake
*Assistant Examiner*—Mark S. Bicks
*Attorney, Agent, or Firm*—Wofford, Felsman, Fails & Zobal

[57] ABSTRACT

An electrical connector adapted to be inserted through an opening of a bulk head and attached thereto and which includes two electrical contacts which may be removed from either side of the connector.

10 Claims, 4 Drawing Figures

ELECTRICAL CONNECTOR

SUMMARY OF THE INVENTION

It is an object of the present invention to provide a novel and useful electrical connector which may be readily assembled and disassembled.

It is another object of the invention to provide an electrical connector adapted to be inserted through an opening of a bulk head and attached thereto and which includes two electrical contacts which may be removed from either side of the connector.

The electrical connector comprises a housing having an opening formed therethrough. Located in the housing is an insulating cylindrical means having an opening formed therethrough in which is located a metallic cylinder also having an opening formed therethrough. Two contacts, each adapted to have an electrical lead connected thereto, are provided to be inserted into the opening of the metallic cylinder through its opposite ends. Two removable nut means hold the contacts in the metallic cylinder and two removable end caps hold the assembly in the housing.

BRIEF DESCRIPTION OF THE DRAWINGS

FIGS. 3A and 3B may be placed together to show the proper relationship of the component parts of the electrical connector by placing the lower part of FIG. 3A next to the upper part of FIG. 3B.

DETAILED DESCRIPTION OF THE INVENTION

Figure 1:
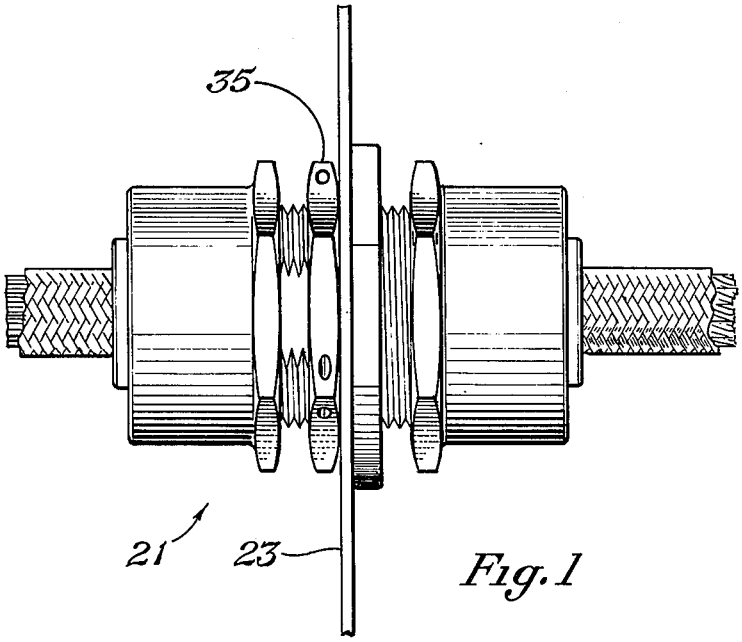
FIG. 1 is a side view of the electrical connector of the present invention shown assembled together and connected to a bulk head.
Figure 2:
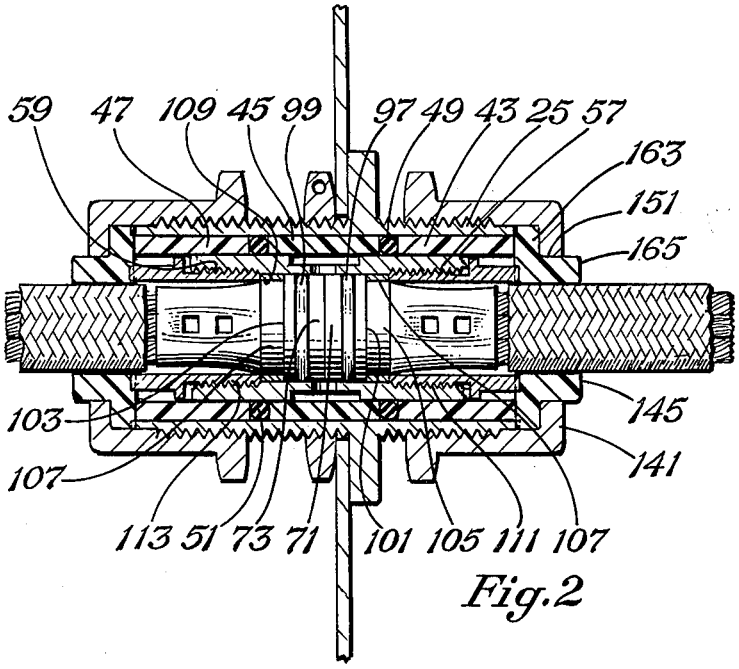
FIG. 2 is a cross-sectional view of the electrical connector of FIG. 1.
Figure 3A:
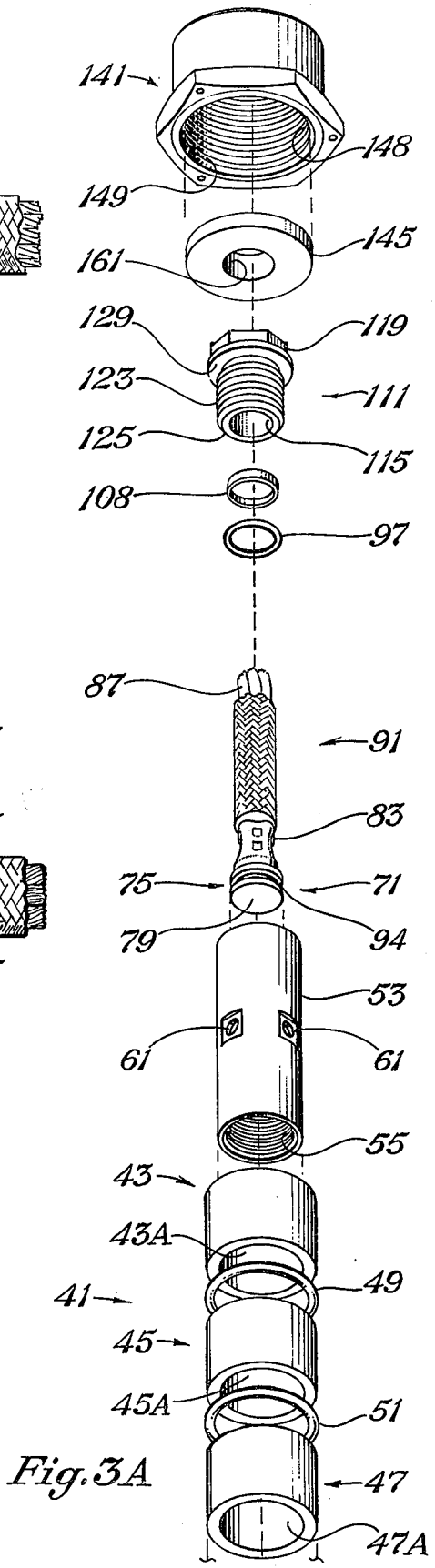
FIGS. 3A and 3B is an exploded view of the electrical connector of FIGS. 1 and 2.
Figure 3B:
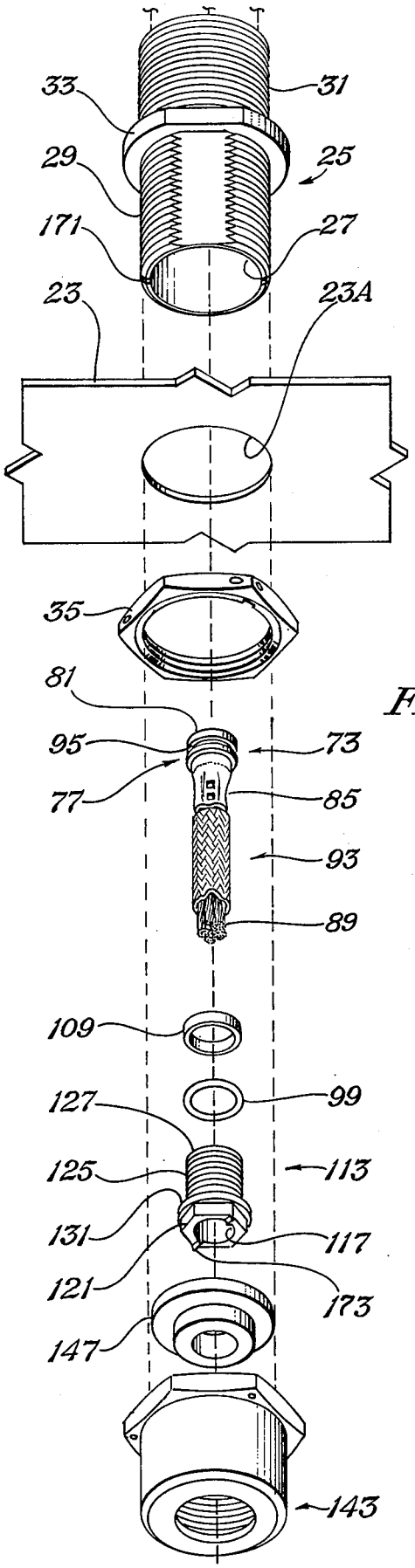

Referring now to FIGS. 1 and 2, the electrical connector of the present invention is identified by reference numeral 21 and is shown attached to a bulk head 23 which may be that of a helicopter. Also referring to FIGS. 3A and 3B, the electrical connector 21 comprises a cylindrical housing 25 having an opening 27 formed therethrough and threads 29 and 31 formed on its exterior as well as a stop member 33. The end of the housing on which threads 29 are formed may be inserted through the opening 23A of the bulk head 23 until the stop member 33 abuts against the bulk head. A nut 35 then may be threaded onto threads 29 on the other side of the bulk head to secure the housing to the bulk head.

Located in the housing 25 is a removable hollow insulating cylinder 41 comprising three hollow cylindrical members 43, 45, 47 having openings 43A, 45A and 47A formed therethrough. The cylindrical members 43, 45 and 47 are adapted to be inserted into the opening 27 of the housing 25 with a resilient O-ring seal 49 located between cylinders 43 and 45 and a resilient O-ring seal 51 located between cylinders 45 and 47. Removably located inside the cylinders 43, 45 and 47 is a hollow metallic cylinder 53 having an opening 55 formed therethrough. Threads 57 and 59 are formed on the inside of the metallic cylinder 53 at its opposite ends. Apertures 61 are also formed through the wall of the cylinder 53 at its mid-point.

Two electrical contacts 71 and 73 are provided and which have cylindrically shaped front ends 75 and 77 respectively with flat front faces 79 and 81 respectively. The rear ends 83 and 85 of the contacts are hollow for receiving the wires 87 and 89 of two electrical leads 91 and 93. The rear ends 83 and 85 of the two contacts 71 and 73 are crimped to the wires of the leads as shown in the drawings. The two electrical contacts 71 and 73 are adapted to be inserted into the opening 55 of the cylinder 53 through its opposite ends with their two flat front faces in abutting relationship as seen in FIG. 2.

The front ends of the two contacts 71 and 73 have grooves 94 and 95 formed in their peripheries in which are fitted resilient O-rings 97 and 99 as shown in FIG. 2. Also formed at the front ends of the two contacts 71 and 73 are rearward facing shoulders 101 and 103 which join two smaller diametered cylindrical surfaces 105 and 107 respectively just ahead of the crimped rear end portions 83 and 85. Two small cylindrical rings 108 and 109 are adapted to fit around the surfaces 105 and 107 and against the shoulders 101 and 103 respectively. Two hollow cylindrical nut members 111 and 113 are provided which have openings 115 and 117 formed therethrough. These nut members are adapted to fit around the leads 91 and 93 and around the crimped portions 83 and 85 of the contacts 71 and 73. The members 111 and 113 have hexagon shaped surfaces 118 and 121 at their rear ends for a wrench and threads 123 and 125 formed on their exterior at their front ends. When the contacts 71 and 73 are inserted into the opening 55 through opposite ends of the cylinder 53 in abutting relationship, members 111 and 113 are threaded into the opposite ends of the metallic cylinder 53 to hold the contacts 71 and 73 in place in abutting relationship as seen in FIG. 2. In this respect, the forward ends 125 and 127 of the members 111 and 113 abut against the rings 108 and 109 which in turn are abutted against the shoulders 101 and 103 respectively of the contacts 71 and 73 to hold the contacts in place. Shoulders 129 and 131 of the members 111 and 113 limit the inward movement of these members. Contacts 71 and 73, nut members 111 and 113 and rings 108 and 109 respectively are identical in shape and size.

Also provided are two cup-shaped end caps 141 and 143 and two insulating sealing members 145 and 147. The end cap 141 has a large forward opening 148 with threads 149 formed on the inside and a smaller rear opening 151. The end cap 143 is identical in shape and size as end cap 141. The end caps 141 and 143 are adapted to be threaded to the threads 31 and 29 formed on the exterior of the housing. The insulating member 145 has a small opening 161 formed therethrough and is adapted to snugly fit around the lead 91. The insulating member 145 also has a forward flange 163 adapted to snugly fit within the opening 147 at the rear end of the end cap 141 and abut against the end of the cylindrical member 43 and housing 25. The rear end 165 is adapted to extend through opening 151 and out of the end cap 141 as shown in FIG. 2. The insulating member 147 is identical in size and shape as insulating member 141 and is adapted to be fitted around the other lead 93 and within the other end cap 143.

In assembly, the housing is attached to the bulk head as described above. The cylinder 41 comprising the cylindrical members 43, 45 and 47 and O-ring 49 and 51 are inserted into the housing 25. They may be inserted from either end of the housing. One of the contacts 71 or 73 with its lead is inserted into the one end of the metal cylinder 53 until its front flat face is at the mid-point as seen through the apertures 61. For example, assume that contact 71 is inserted first into cylinder 53 through one end. Its nut member 111 is then threaded into the end of cylinder 53 against its ring 108 until ring 108 abuts against the shoulder 101 of contact 71 and shoulder 129 abuts against the end of cylinder 53. The metal cylinder 53, by way of its other end, then will be inserted into the insulating cylinder 41. The other contact 73 then will be inserted into the other end of the metal cylinder 53 until its flat front face abuts against the front face of the contact 71. The other nut member 113 will be threaded into cylinder 53 against its ring 109 until ring 109 abuts against the shoulder 103 of the contact 73. Next the end caps 141 and 143 with their insulating members 145 and 147 will be threaded to the ends of the housing 25. Projections 171 and 173 are formed on the ends of the housing 25 and nut members 111 and 113 respectively to form a tight connection with the insulating members 145 and 147 when the end caps 141 and 143 are threaded in place. In this respect projections 171 embed in members 145 and 147 and keep these members from turning. Projections 173 also embed in members 145 and 147 and provide a self-locking feature that prevents members 111 and 113 from loosening in service due to vibration and other factors. The end caps 141 and 143 may have self-locking features i.e. a nylon compound on the threads or they can be locked with wire. If it is desired to remove one of the contacts, its end cap and its nut member may be unthreaded and the contact pulled out of the metallic cylinder 53.

The purpose of the O-rings 49 and 51 is to provide a water tight seal between the housing and the metal member 53. In certain instances, however, it may be desired to have the cylinder 41 formed as a single unitary member. O-rings 97 and 99 are provided to form a water tight seal between the inside of the member 53 and contacts 71 and 73.

In one embodiment the contacts 71 and 73 may be formed of copper alloy. The housing 25, cylinder 53 and end caps 141 and 143 are of metal. The O-rings 49, 51, 97 and 99 are silicone O-rings. The cylinders 43, 45 and 47 and members 145 and 147 are formed of suitable electrical insulating material such as teflon.

I claim:

1. An electrical connector for connecting two leads together, comprising:

a housing having a cylindrical opening formed therethrough, electrical insulating cylindrical means located in said opening, said electrical insulating cylindrical means being separate from said housing and removable from said opening, said electrical insulating cylindrical means having an opening formed therethrough, a metallic cylinder located in the opening of said insulating cylindrical means and having threads formed in its inside wall at opposite ends thereof, said metallic cylinder having an opening formed therethrough and having two contacts received through its opposite ends, each contact adapted to have an electrical lead connected thereto, said two contacts having shoulders extending outwardly therefrom, two holding means adapted to be fitted around said contacts and having threads formed on their outer surfaces and adapted to be threaded into opposite ends of said metallic cylinder for applying a holding force to said shoulders of said contacts for holding said contacts in said metallic cylinder, said housing having threads formed on its outer surface at opposite ends thereof, and two cup-shaped end caps, each having an inside cylindrical wall with threads formed therein, a first end with a large opening, and a rear wall at an opposite end with a small opening formed therethrough, said small opening of each end cap having a diameter less than the outside diameter of the ends of said housing and of a size sufficient to receive one of said leads, the size of said large opening of each end cap being sufficient to allow each end cap to be fitted around and threaded to one end of said housing.

2. The electrical connector of claim 1 wherein:

said contacts have flat ends, said holding means hold said contacts in said metallic cylinder with their flat ends in abutting relationship.

3. The connector of claim 1 comprising:

means for securing said housing to a bulk head or the like with said housing extending through an opening formed in said bulk head and with opposite ends of said housing located on opposite sides of said bulk head.

4. The connector of claim 1 comprising:

a relatively soft annular insulating member located in each of said cup-shaped end caps at its rear end and adapted to engage an end of said housing and an end of said one of said holding means when each end cap is fitted around and threaded to said housing, said housing having projections extending from its opposite ends to be embedded in said annular insulating members when said end caps are fitted around and threaded to said housing, said holding means having projections extending from their ends to be embedded in said annular insulating members when said end caps are fitted around and threaded to said housing.

5. The connector of claim 1 wherein:

each of said holding means has a cylindrically shaped opening formed therethrough to be fitted around said contacts.

6. The connector of claim 5 wherein:

said contacts have flat ends, said holding means hold said contacts in said metallic cylinder with their flat ends in abutting relationship.

7. The connector of claim 6 comprising:

a relatively soft annular insulating member located in each of said cup-shaped end caps at its rear end and adapted to engage an end of said housing and an end of said one of said holding means when each end cap is fitted around and threaded to said housing, said housing having projections extending from its opposite ends to be embedded in said annular insulating members when said end caps are fitted around and threaded to said housing, said holding means having projections extending from their ends to be embedded in said annular insulating members when said end caps are fitted around and threaded to said housing.

8. The connector of claim 1 wherein:

said contacts are fixedly connected to said electrical leads.

9. The electrical connector of claim 8 wherein:

each of said holding means has a cylindrically shaped opening formed therethrough to be fitted around said contacts.

10. An electrical connector for connecting two leads together, comprising:

a metallic housing having a cylindrical opening formed therethrough, electrical insulating cylindrical means located in said opening, said electrical insulating cylindrical means having an opening formed therethrough, a metallic cylinder located in the opening of said insulating cylindrical means and having threads formed in its inside wall at opposite ends thereof, said metallic cylinder having an opening formed therethrough and having two contacts received through its opposite ends, each contact adapted to have an electrical lead connected thereto, said two contacts having shoulders extending outwardly therefrom, two holding means having cylindrically-shaped openings formed therethrough to be fitted around said contacts and having threads formed on their outer surfaces and adapted to be threaded into opposite ends of said metallic cylinder for applying a holding force to said shoulders of said contacts for holding said contacts in said metallic cylinder, said housing having threads formed on its outer surface at opposite ends thereof, and two cup-shaped end caps, each having an inside cylindrical wall with threads formed therein, a first end with a large opening, and a rear wall at an opposite end with a small opening formed therethrough, said small opening of each end cap having a diameter less than the outside diameter of the ends of said housing and of a size sufficient to receive one of said leads, the size of said large opening of each end cap being sufficient to allow each end cap to be fitted around and threaded to one end of said housing.

* * * * *